US006358322B1

(12) United States Patent
Pahl

(10) Patent No.: US 6,358,322 B1
(45) Date of Patent: Mar. 19, 2002

(54) APPARATUS TO FEED FLOWING MEDIA IN METERED MANNER

(75) Inventor: Andreas Pahl, Hilden (DE)

(73) Assignee: ITW Industrie GmbH, Mettmann (DE)

( * ) Notice: Subject to any disclaimer, the term of this patent is extended or adjusted under 35 U.S.C. 154(b) by 0 days.

(21) Appl. No.: 09/533,116

(22) Filed: Mar. 22, 2000

(30) Foreign Application Priority Data

Mar. 24, 1999 (DE) ..... 199 13 159

(51) Int. Cl.[7] ..... B05B 15/08
(52) U.S. Cl. ..... 118/680; 118/323; 239/587.1
(58) Field of Search ..... 118/668, 676, 118/679, 680, 323, 201; 239/587.1, 587.2, 476, 477, 478, 479, 480, 481, 482, 483, 225.1, 418, 420, 566; 427/207.1, 208.2, 284, 285, 286

(56) References Cited

U.S. PATENT DOCUMENTS 4,710,399 A * 12/1987 Dennis ..... 437/245
5,683,037 A * 11/1997 Rochman et al. ..... 239/536
5,720,418 A * 2/1998 Timmerman et al. ..... 222/309

* cited by examiner

*Primary Examiner*—Richard Crispino
*Assistant Examiner*—Yewebdar T Tadesse
(74) *Attorney, Agent, or Firm*—Lowe Hauptman Gilman & Berner, LLP

(57) ABSTRACT

An apparatus for feeding a fluid comprises a deposition head having a main surface, spaced feed ducts arranged on the main surface along a length of the deposition head for feeding the fluid and a channel formed on the main surface and extending at least along entirely the length of the deposition head. The apparatus further comprises a spacer plate slidably supported by the channel so that the spacer plate can be fastened to the main surface at any position along the entire length of the channel. A deposition module is mounted on the spacer plate and has a nozzle in communication with at least one of the feed ducts for depositing the fluid. The apparatus advantageously facilitates reposition of the nozzle with minimal effort.

19 Claims, 5 Drawing Sheets

APPARATUS TO FEED FLOWING MEDIA IN METERED MANNER

FIELD OF THE INVENTION

The invention relates to an apparatus to feed in metered (or dosed) manner, flowing media, in particular such as hot-melt glues, cold glue, lubricants, paints or the like.

BACKGROUND ART

A known apparatus comprises a deposition head fitted with an outside surface into which issue a large number of mutually spaced flowing-media feed ducts arranged in a row, at least one of said ducts communicating through a spacer plate with a deposition module having a nozzle head to deposit adhesive in spots, lines or zones onto a substrate moving past, each spacer plate making available a duct spanning the distance between at least two feed. ducts and an assembly position for the deposition module.

Such a state of the art already is known illustratively in the form of a deposition head with intermediate plate allowing to position a deposition module also in a zone between two glue feed ducts. While this design makes it possible to also advantageously mount a deposition module between two feed ducts, on the other hand different spacer plates shall be required for different assembly positions between the feed ducts. Moreover the deposition heads require fasteners for affixation to the spacer plate.

Furthermore a deposition head is known, though not from the literature, which allows affixing the deposition modules using a rotatable spacer plate. However the nozzle adjusting range is quite narrow in this state of the art. Also, the distance between nozzle and substrate increases disadvantageously on account of the changed position of the deposition module. Again, a jet of medium which is obliquely applied to the substrate hampers precise positioning and formation for instance of an accurately bounded glue spot.

Based on the first cited state of the art, it is therefore the object to create apparatus controlling flowing media and allowing affixation of the deposition modules in every position at minimal effort.

This problem is solved by the features of claim 1, in particular by those unique to the invention, whereby the spacer plate is mounted in continuously adjustable manner at the outside surface along the mouths of the feed ducts at the deposition head.

The apparatus of the invention henceforth makes it possible to affix deposition modules mounted on one or more spacer plates in any arbitrary position. This feature substantially lowers the cost of converting a deposition head when another substrate must be fitted with a liquid medium.

In one embodiment of the invention, the deposition head comprises a guide channel running parallel to the feed ducts and receiving at least one channel or sliding block displaceably connected to the spacer plate. In this design, repositioning can be implemented merely by laterally displacing the spacer plate jointly with the deposition module by partly loosening the connection between spacer plate and channel or sliding block.

In a further advantageous embodiment of the invention, the spacer plate's surface facing the deposition head is fitted with a slot receiving a flat seal comprising the junction duct. The above slot is easily processed into the surface facing the deposition head in this embodiment of the invention, while the flat seal, which also is easily manufactured and which in its relaxed state slightly projects from the groove, only requires being inserted into this slot.

In a further embodiment of the invention improving positioning, the slot may be bounded bilaterally with one closing plate each mounted to a side of the spacer plate, thereby allowing accurate positioning of the flat seal in the slot.

A further embodiment of the invention comprises a junction duct directly processed into the spacer plate's surface facing the deposition head, said junction duct being sealed merely by affixing the spacer plate to the deposition head. Because the spacer plate is pressed against the deposition head in this embodiment of the invention, the junction duct is sealed by the bilaterally abutting metal surfaces.

The above embodiment may be altered to the extent that only a recess is made into the spacer plate's surface facing the deposition head, said recess receiving a flat seal comprising a junction duct. This feature offers the basic advantage of lesser compression being required between the spacer plate and the deposition head because in this instance the seal is not metallic.

In a further preferred embodiment of the invention, the spacer plate is fitted with an integrated air connector which can be hooked up by means of a multi-way valve and a flexible hose, further by a pneumatic connector, to a compressed-air tube running parallel to the deposition head's outside surface. On account of this easily restructured and flexible compressed-air infrastructure, changing the spacer plate's position and hence that of one or more deposition modules shall be simplified further and last but not least the displaceability of the spacer plate shall be substantially increased.

BRIEF DESCRIPTION OF THE DRAWINGS

Further advantages of the invention are stated in the sub-claims below and in the description of an illustrative embodiment.

DETAILED DESCRIPTION OF THE INVENTION

Figure 1:
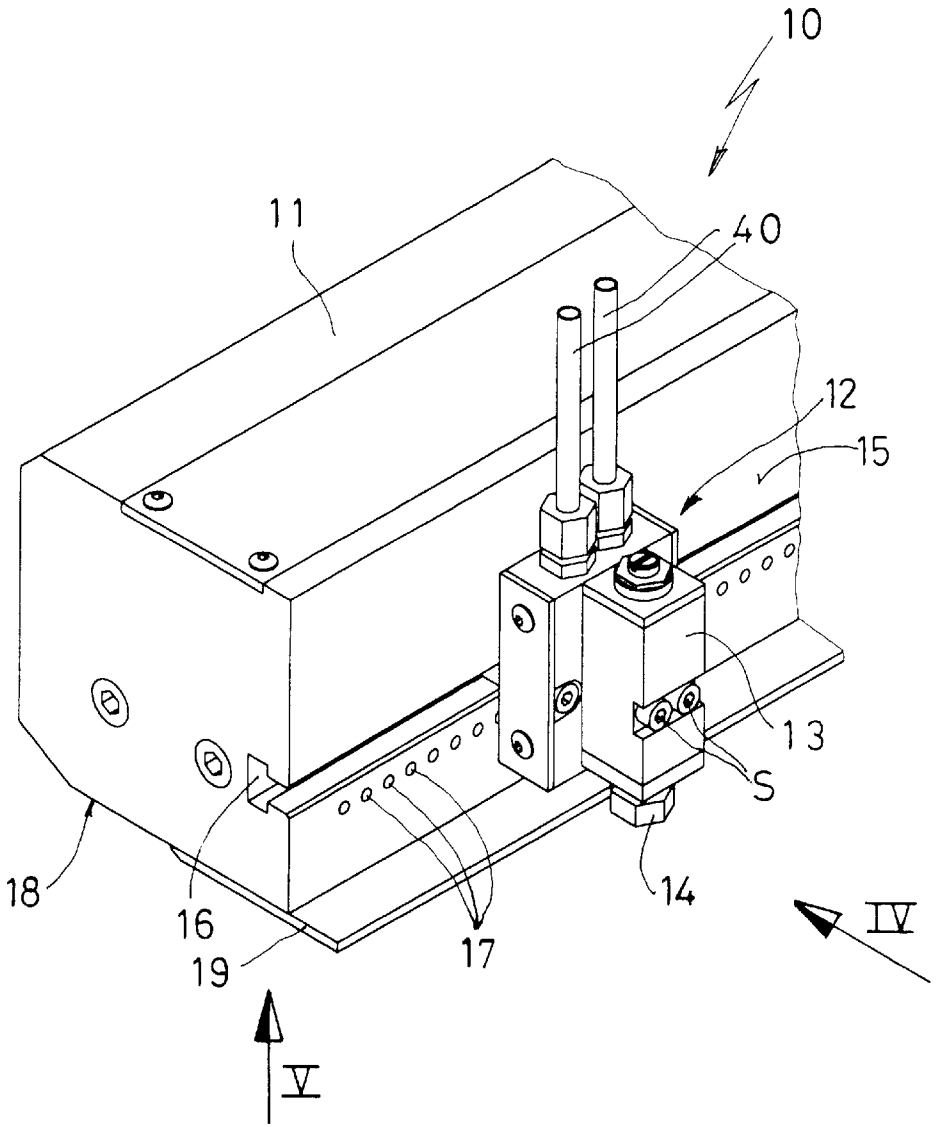
FIG. 1 is a perspective of part of a deposition head.

The drawings show an apparatus 10 to feed flowing media in metered, ie in controlled manner.

Such apparatus 10 comprises a deposition head 11, at least one spacer plate 12 and a deposition module 13 fitted with a nozzle head 14.

FIG. 1 is a perspective of such apparatus 10. It also shows an outside surface 15 of the deposition head 11, said surface being fitted with a horizontal T-shaped slide channel 16. A row of glue feed ducts 17 illustratively equidistant for instance by 8 mm from each other is shown below the slide channel 16. Whereas the spacer plate 12 is affixed in the manner described below to the outside surface 15, the deposition module 13 on the other hand is merely fastened by screws S to the spacer plate 12.

Finally a plate 19 is shown at the lower surface 18 and among other functions also serves as a guide for an omitted substrate, for instance a piece of folded cardboard, which runs underneath the nozzle head.

Figure 2:
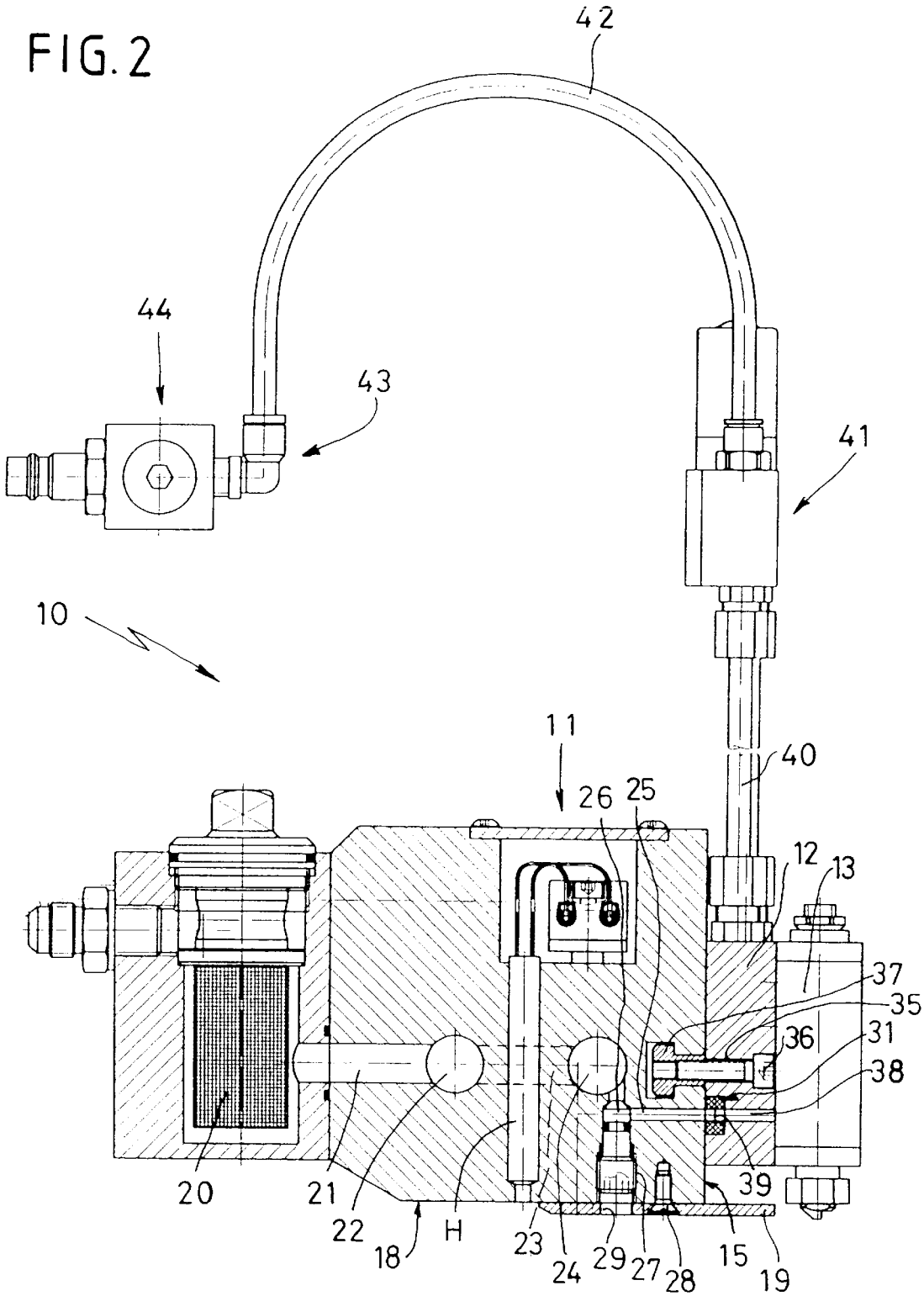
FIG. 2 is a partial section of the deposition head of FIG. 1.

FIG. 2 is a detailed view of the apparatus 10, the description to follow relating solely to those elements affected by the invention. The glue feed controlled by the deposition module 13 is implemented first through a filter unit 20 and a junction duct 21 to the pressurizing duct 22 which in turn communicates through a further duct 23 with a pressure manifold duct 24. A large number of glue feed ducts 25, arrayed in a row as shown in FIG. 1, run from the pressure manifold duct 24 to issue at the outside surface 15.

A heating cartridge H mounted between the pressure manifold duct 24 and the pressurizing duct 22 is significant in the operation of the above described glue feed system.

Figure 5:
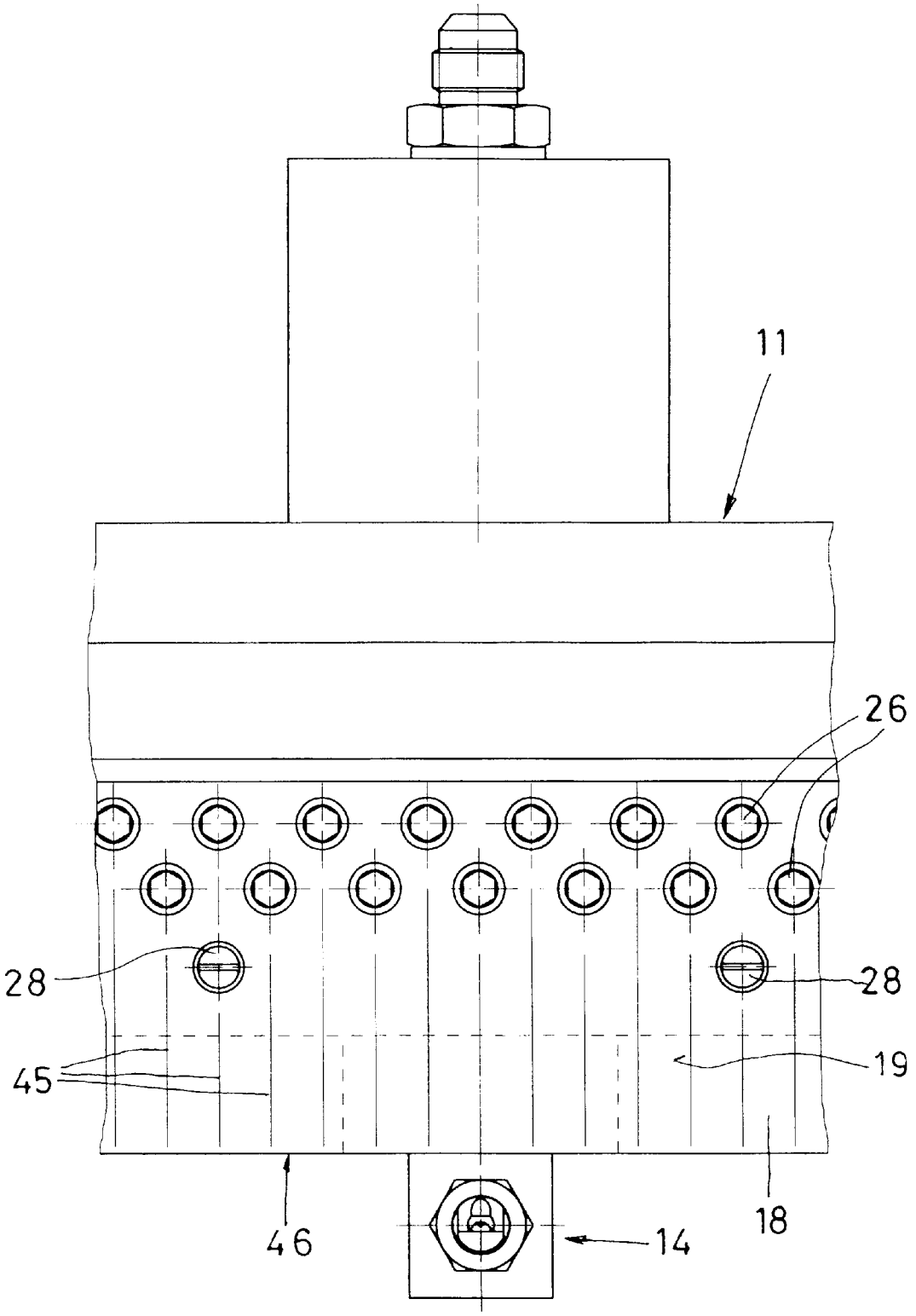
FIG. 5 is a cutaway view from below along the arrow V of FIG. 1.

FIG. 2 shows that each feed duct 25 can be shut off by means of a shutoff screw 26 fitted with an O-ring. The shutoff screw 26 is seated in a vertical borehole 27 in the lower surface 18. The plate 19 is affixed by screws 28 to rest against the lower surface 18. The plate 19 comprises boreholes 29 which are smaller than said shutoff screws and which are flush with boreholes 27 arrayed in a row and seating the shutoff screws 26 (FIG. 5). The purpose of this design is that the plate 19 additionally secures the shutoff screws 26: using a socket wrench for instance, the shutoff screws 26 in the form of hexagonal socket screws can be moved into a shutoff or into an open position depending on the position of the spacer plate 12. When the shutoff screw 26 is loosened, the smaller cross-sectional borehole 27 acts as open-position stop for the shutoff screw 26, this stop at the same time also preventing losing the shutoff screws 26.

Figure 3:
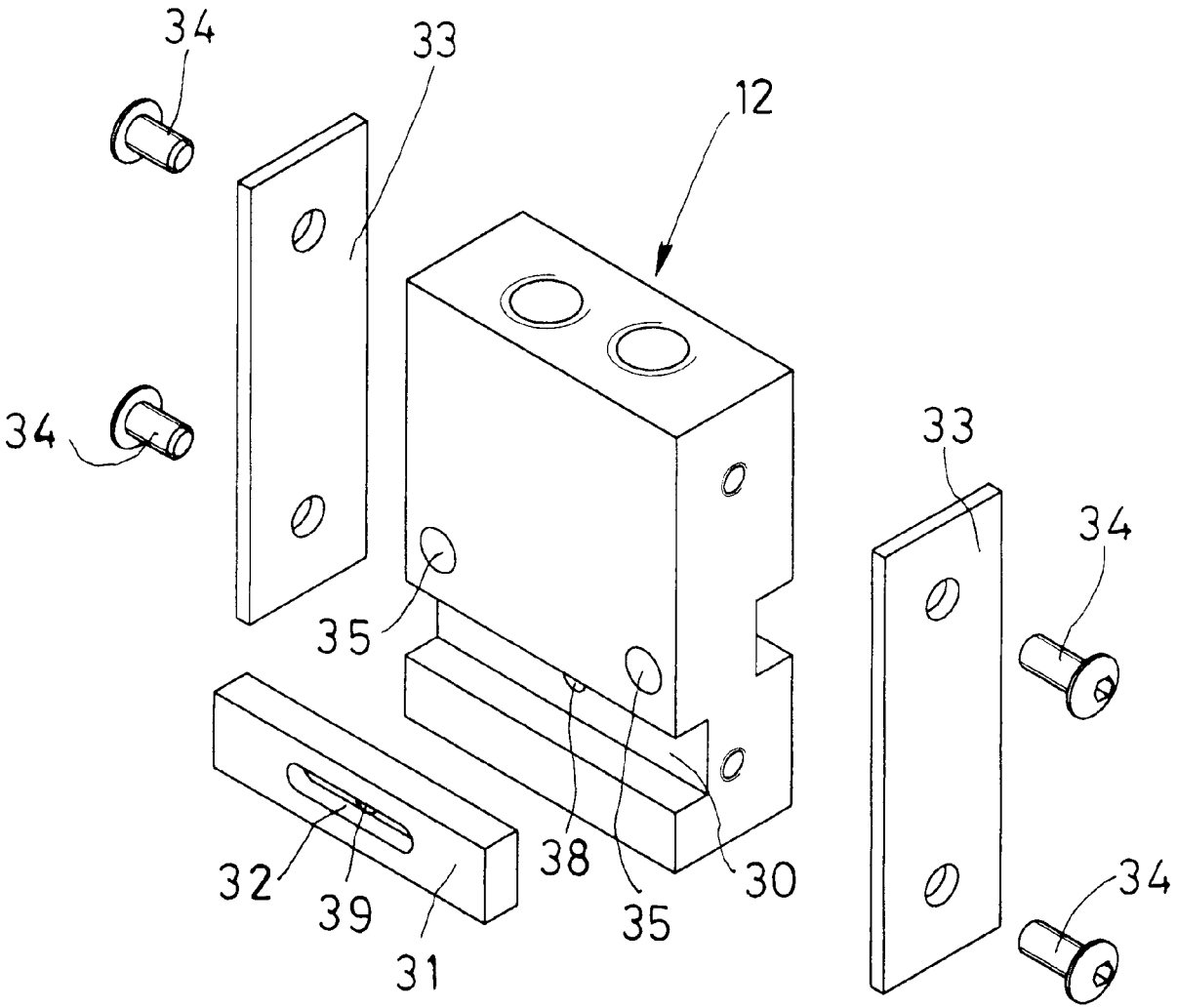
FIG. 3 is an exploded view of a spacer plate.

The spacer plate 12 is affixed to the outside surface 15. The spacer plate 12 is shown in detail in FIG. 3. FIG. 3 furthermore shows a slot 30 facing the outside surface 15 of the deposition head 11 (see FIG. 1) and designed to receive a flat seal 31 comprising a junction duct 32. The junction duct 32 includes a side duct 39 which, following insertion of the flat seal 31 into the slot 30, shall be aligned with a duct 38 in the spacer plate 12. Following positioning of the flat seal 31 in the slot 30, laterally securing plates 33 may be affixed by screws 34 to the spacer plate 12.

Figure 4:
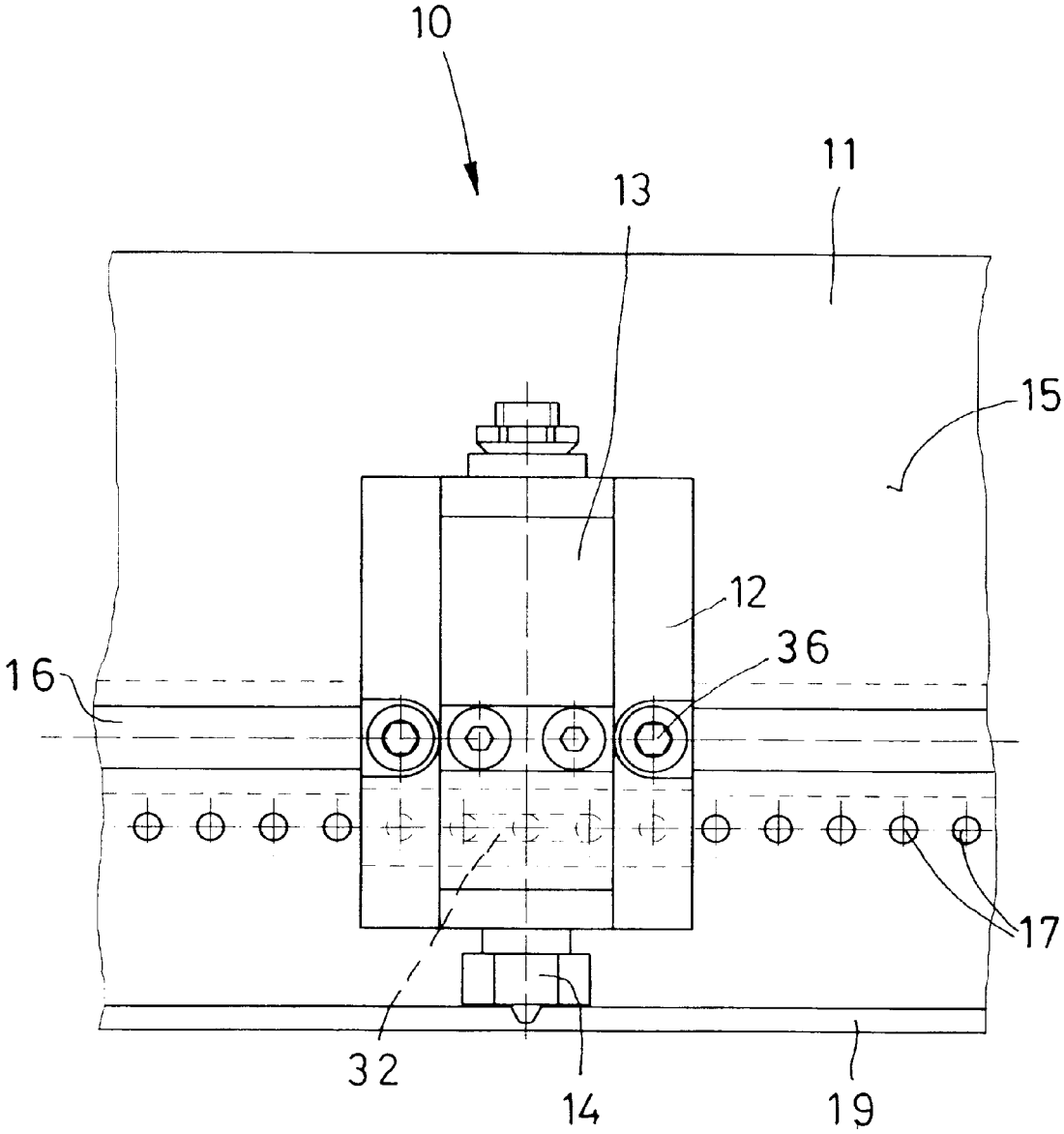
FIG. 4 is a cutaway front view along the arrow IV of FIG. 1.

FIG. 3 further shows two mutually spaced boreholes 35 which, as shown in FIG. 4, may receive hexagonal socket screws 36 that are screwed into channel or sliding blocks 37 inside the slide channel 16. Tightening the hexagonal socket screws 36 allows firmly positioning the spacer plate 12 to the outside surface 15. At the same time the flat seal 31 projecting above the contour of the spacer plate 12 shall be compressed in sealing manner.

The affixation of the spacer plate 12 to the outside surface 15 entails making the feed duct 25 longer because the junction duct 32 is fitted with the side duct 39 which creates communication with the duct segment 38 in the spacer plate 12. Because the deposition module 13 also comprises, if in omitted form, a corresponding glue feed duct, glue supply to the nozzle head 14 is assured thereby.

FIGS. 1 and 2 also show two air feed lines 40 connected to the spacer plate 12 and communicating through a multi-way valve 41, a hose 42 and a pneumatic connector 43 with a compressed-air tube 44 running parallel to the outside surface 15 of the deposition head 11.

The front view of FIG. 4 shows that following affixation of the spacer plate 12 together with the deposition module 13, the junction duct 32 in the flat seal 31 allows feeding glue into the deposition module 13, hence into the nozzle head 14. FIG. 4 shows in dashed lines the junction duct 32, which in this instance extends over three glue feed ducts 25. When one of the ducts 25 is opened using a pertinent hexagonal socket screw, an open duct to feed glue as far as into the nozzle head 14 will then have been implemented.

By merely loosening the hexagonal-socket screws 36, it is also feasible, in very simple manner, to shift the unit consisting of spacer plate 12 and deposition module 13 left or right into any desired position, two feed ducts 25 being available in every instance to supply glue to the nozzle head 14.

Lastly FIG. 5 shows the apparatus 10 in cutaway section and from below. It shows the nozzle head 14 and the plate 19 projecting as far as the nozzle head 14, a large number of indicator lines 45 running from the central axis of a shutoff screw 26 toward a peripheral edge 46 of the plate 19. These marking 45 easily which shutoff screw 26 and hence which associated feed duct 25 must be opened to assure feed to a deposition module mounted in a given position.

What is claimed is:

1. An apparatus for feeding a fluid, comprising:

a deposition head having a main surface;

a plurality of spaced feed ducts arranged on the main surface along a length of said deposition head for feeding the fluid;

a channel formed on the main surface and extending at least along entirely said length of said deposition head;

a spacer plate slidably supported by said channel so that said spacer plate can be fastened to the main surface substantially at any position along substantially entirely said length of said deposition head; and a deposition module mounted on the spacer plate and having a nozzle in communication with at least one duct of said feed ducts for depositing the fluid.

2. The apparatus of claim 1, wherein said channel has a T-shaped cross-section.

3. The apparatus of claim 1, wherein said spacer plate includes a junction duct spanning between and simultaneously communicated with at least two adjacent ducts of said feed ducts.

4. The apparatus of claim 1, wherein said spacer plate includes a junction duct and said at least one duct has an opening an entire area of which is in registry with an opening of the junction duct.

5. The apparatus of claim 1, wherein said spacer plate includes a seal member adapted to be pressed against the main surface in a sealing manner when said spacer plate is fastened to the main surface.

6. The apparatus of claim 5, wherein the seal member includes therein a junction duct spanning between at least two adjacent ducts of said feed ducts for simultaneously communicating said at least two ducts with the nozzle.

7. The apparatus of claim 5, wherein the seal member includes a junction duct and said at least one duct has an opening an entire area of which is in registry with an opening of the junction duct.

8. The apparatus of claim 5, further comprising a sliding block slidably received in said channel, and a fastener for fastening said spacer plate to the sliding block, thereby simultaneously sealingly fastening said spacer plate to the main surface.

9. The apparatus of claim 5, wherein said spacer plate further includes a body having a slot created therein and side plates mounted to opposite sides of the body to define a space in which the seal member is received.

10. The apparatus of claim 1, further comprising an integrated air connector for supplying operating air to one of said spacer plate and deposition module.

11. The apparatus of claim 1, further comprising a guiding plate affixed to said deposition head opposite the nozzle for guiding a moving substrate on which the fluid is to be deposited.

12. The apparatus of claim 1, further comprising a sliding block slidably received in said channel, and a fastener for fastening said spacer plate to the sliding block, and hence the main surface.

13. The apparatus of claim 12, wherein said channel and the sliding block have conforming T-shaped cross-sections.

14. The apparatus of claim 1, further comprising a regulator for selectively regulating an aperture of each of said feed ducts.

15. The apparatus of claim 14, wherein the regulator includes a plurality of shut-off screws each corresponding to one of said feed ducts and movable between first and second positions, the aperture of the corresponding feed duct being fully open and closed when the corresponding shut-off screw is in the first and second positions, respectively.

16. The apparatus of claim 15, wherein the main surface is a side face of the deposition head, the nozzle is oriented toward a bottom face of said deposition head, the feed ducts extend inwardly from the main surface of said deposition head, and each of the shut-off screw is threadably received in a borehole extending inwardly from the bottom surface of said deposition head toward and communicating with the corresponding feed duct.

17. The apparatus of claim 16, further comprising a guiding plate affixed to the bottom surface of said deposition head for guiding a moving substrate on which the fluid is to be deposited.

18. The apparatus of claim 17, wherein the guiding plate is provided with a plurality of through bores each in registry with one of the borehole and having an opening smaller than that of the corresponding borehole, thereby preventing the shut-off screw received in the corresponding borehole from falling off.

19. The apparatus of claim 17, wherein the guiding plate is provided with a plurality of parallel indicator lines each running from a center axis of one of the shut-off screws toward the nozzle, thereby facilitating alignment of the nozzle with desire duct or ducts of said feed ducts.

* * * * *